United States Patent [19]

Klok

[11] 4,244,119

[45] Jan. 13, 1981

[54] PROTRACTABLE STRAIGHT-EDGE WITH VISE

[76] Inventor: Henri Klok, P.O. Box 13714, Houston, Tex. 77019

[21] Appl. No.: 24,382

[22] Filed: Mar. 27, 1979

[51] Int. Cl.[3] ..... B43L 7/02

[52] U.S. Cl. ..... 33/437

[58] Field of Search ..... 33/430, 437, 479, 474, 33/476, 480, 403, 433, 481, 482, 464, 429, 427

[56] References Cited

U.S. PATENT DOCUMENTS

| | | | |
|---|---|---|---|
| 802,202 | 10/1905 | Dougan | 33/437 |
| 1,600,666 | 9/1926 | Dugan | 33/482 |
| 2,936,524 | 5/1960 | Shaffer | 33/430 |

FOREIGN PATENT DOCUMENTS

| | | | |
|---|---|---|---|
| 6243 | of 1898 | United Kingdom | 33/468 |
| 1002692 | 8/1965 | United Kingdom | 33/437 |

*Primary Examiner*—Harry N. Haroian

[57] ABSTRACT

A light weight portable straight-edge which incorporates a complete 180° protractor with a vise for individual position stability. The vise is essentially a common heavy gauge spring establishing a pivot that induces a constant pressure at the extremity of the opposing clamp and straight edge that together have a holding tolerance for materials of ¼" to approximately 2¼".

1 Claim, 5 Drawing Figures

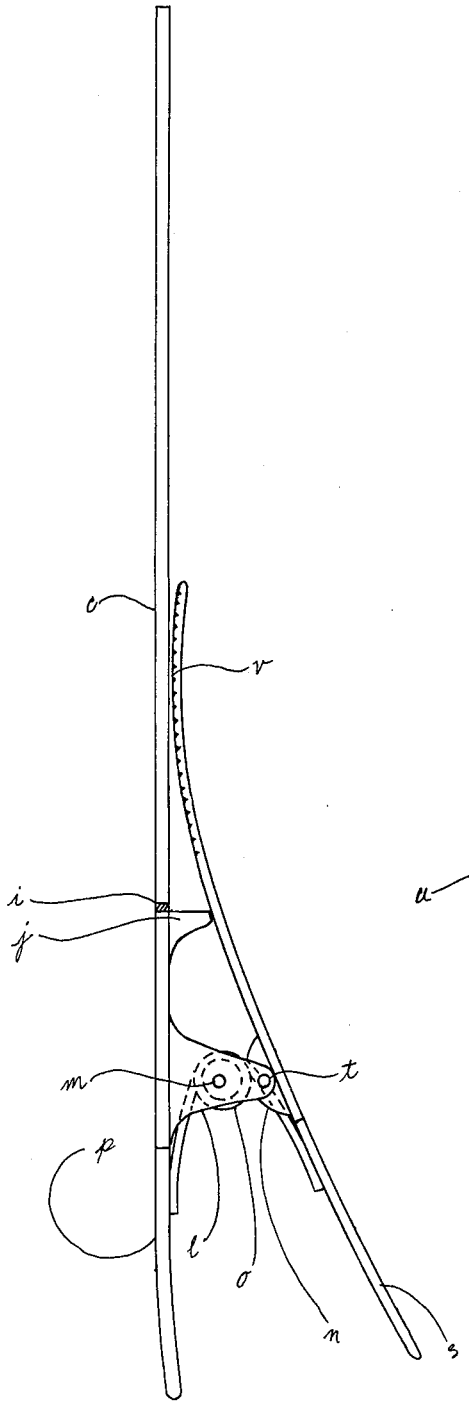
F~2.
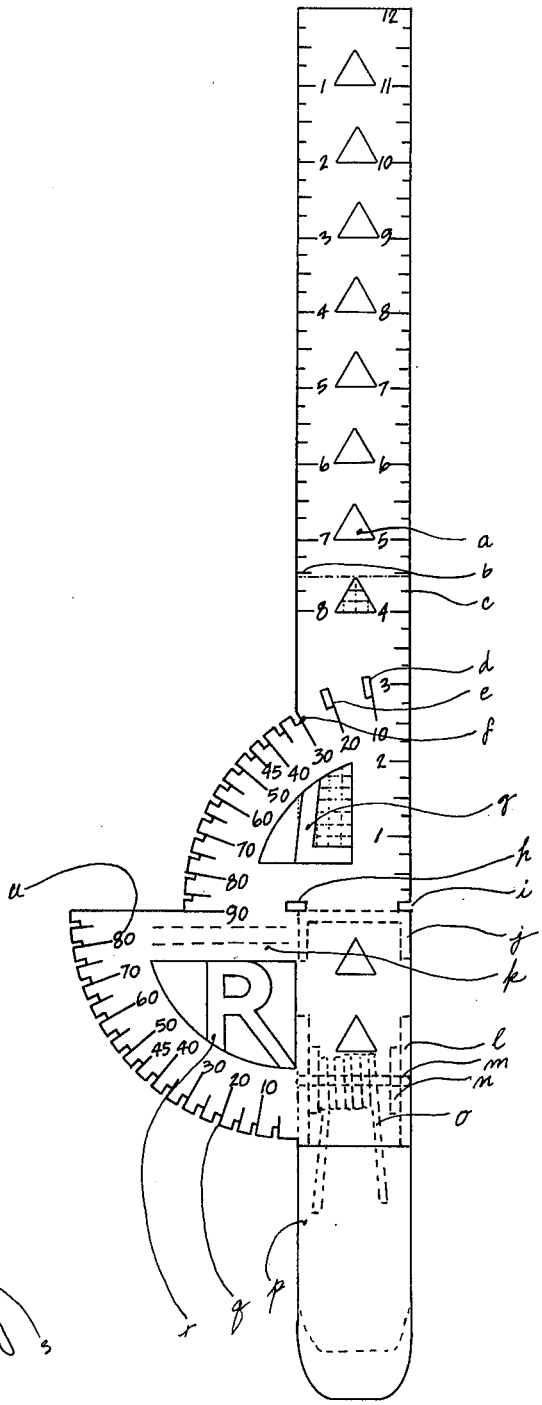
F~1.

PROTRACTABLE STRAIGHT-EDGE WITH VISEcl

BRIEF SUMMARY OF THE INVENTION

The traditional straight-edge in order to adjust to the variable angles deployed by workshops is hereby developed with a full 180° protractor that can be rapidly positioned and marked with ease and thereafter be secured in the given position for the duration of the order of work by the inclusion of a novel vise that allows a large holding tolerance commensurate with most commonly encountered materials. The variance from the 90° vertical division is clearly marked Left or Right congruently with the general directions contingent with the common use of the instrument.

BRIEF DESCRIPTION OF THE DRAWINGS

FIG. 1 is the top view of the invention, having illustrations of the protractor concurrence with the hidden views of the vise mechanism below and the common numerical and name stamping to be found on said invention.

FIG. 2 is a side view illustrating the operation and holding tolerance of the vise assembly and the handle curvatures.

DESCRIPTION OF THE PREFERED EMBODIMENT

Figure 3:
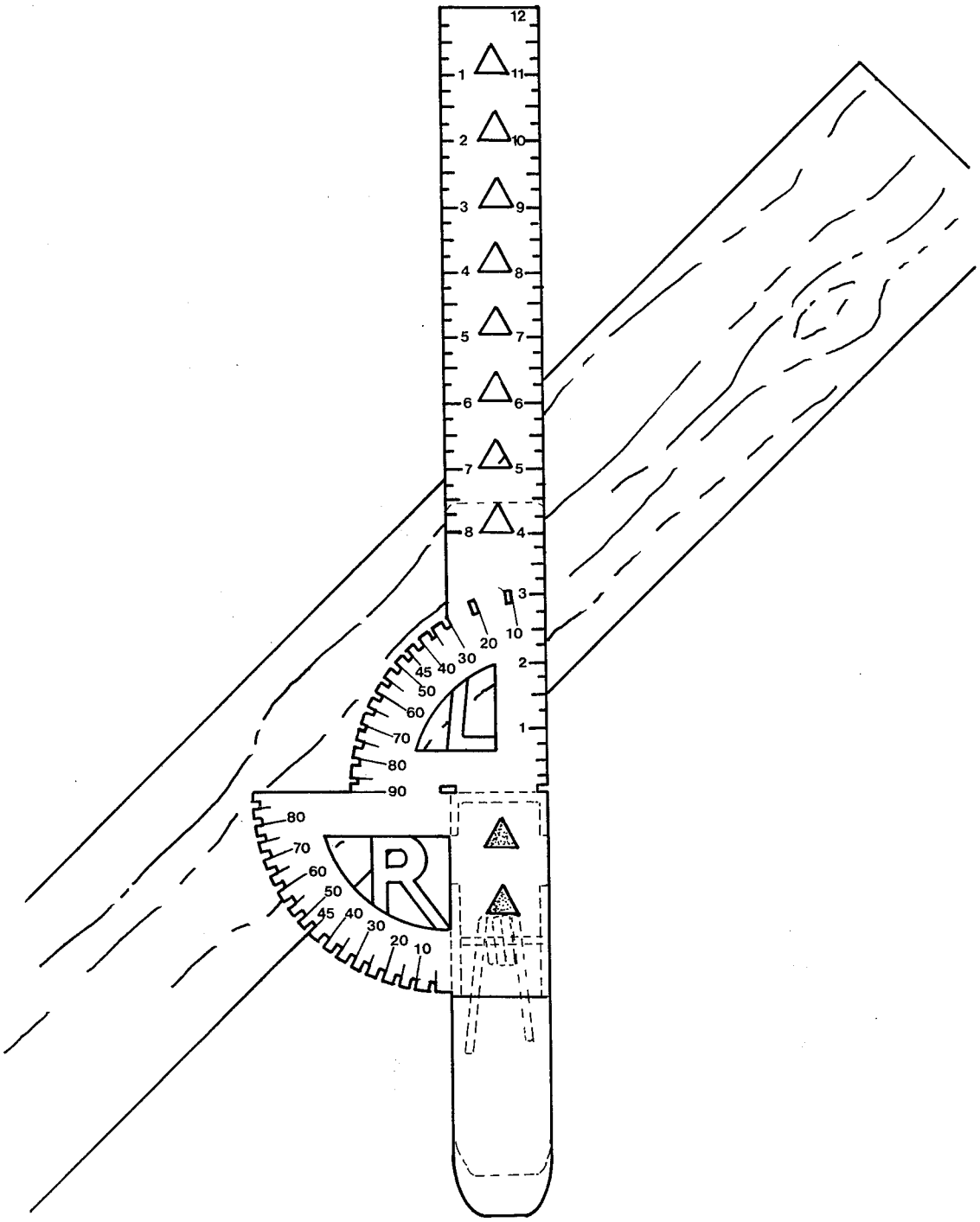
FIGS. 3, 4 and 5 show the device in three operative positions for the marking and cutting of a sample material.
Figure 4:
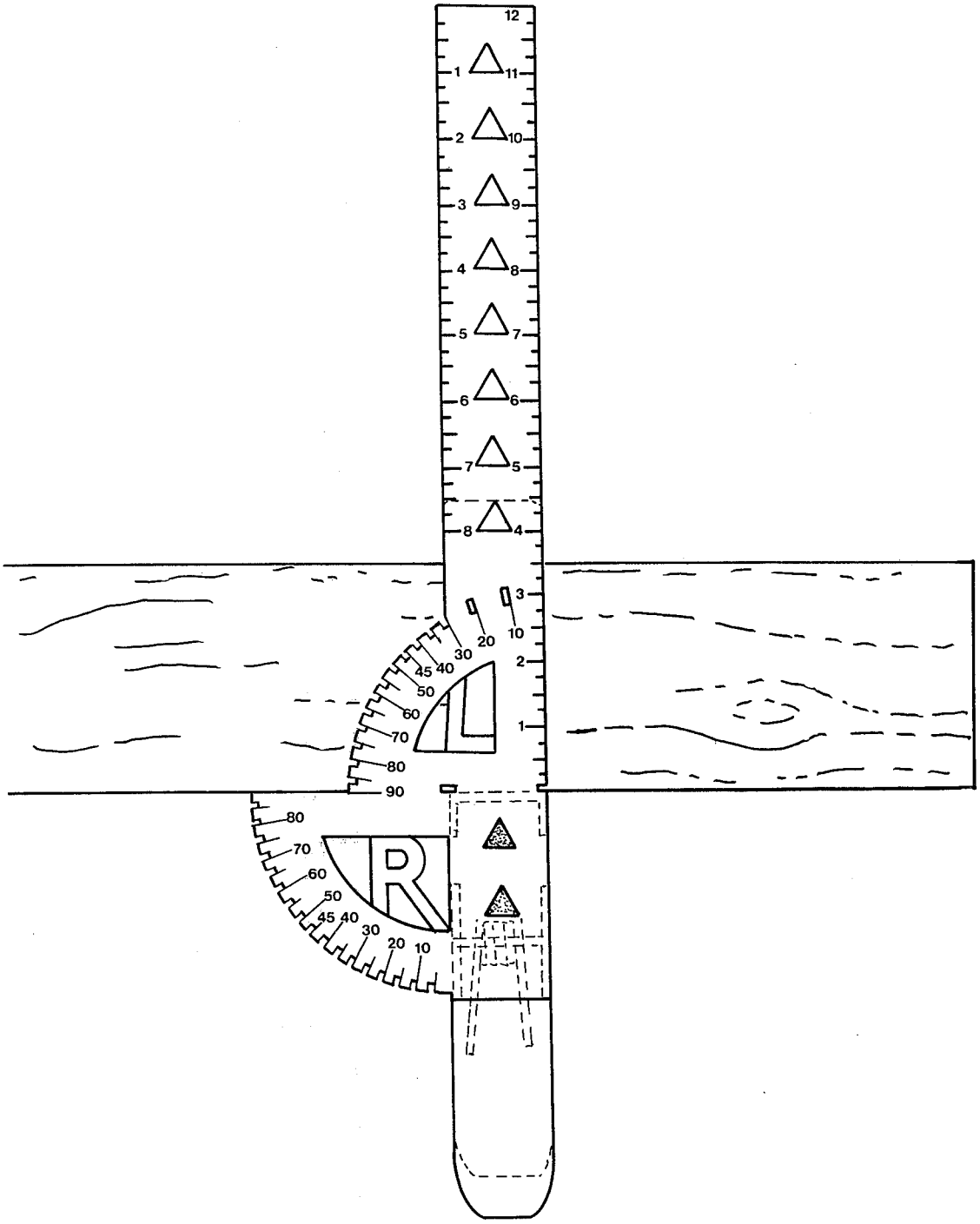
Figure 5:
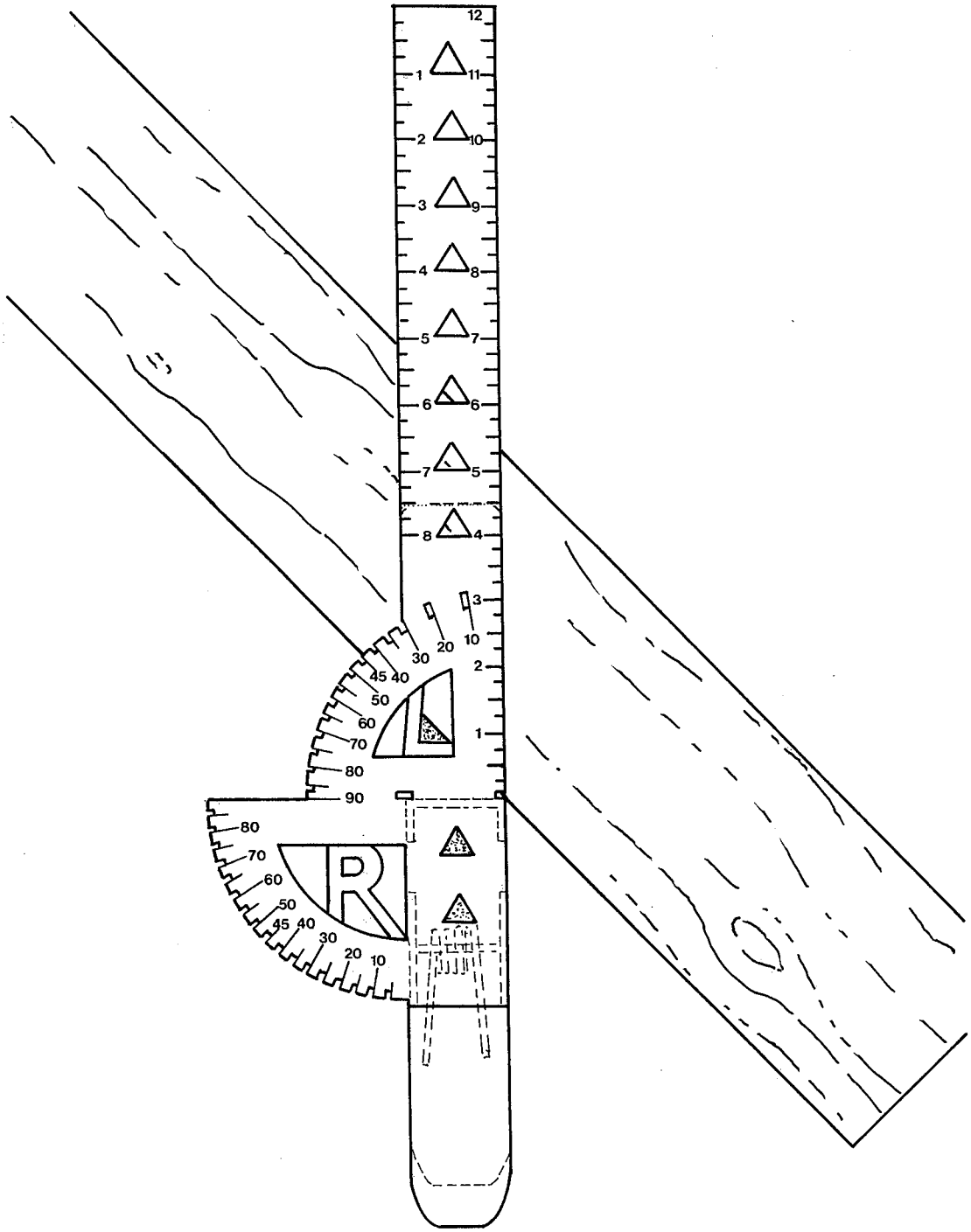

There are three main components to said invention: first, a ruled straight-edge (p); second, a 180° protractor (k); and third, the vise (l-n). Each of the three components is described in detail as follows: (1) The ruled straight-edge (c) is preferably ruled in 1/16" divisions (b) or into millimeters for metric applications. The straight-edge is perforated (a) for a lighter weight advantage and is ruled for a full 12 inch length. The said ruler as well as the entire invention's top fascia should be made of manganese or stainless steel to insure the invention's durability and legibility. (2). The 180° protractor set is divided by a 90° center into halves (q & f) constructed respectively R for right (r) and L for left (g) which signify what angle direction with respect to the user is to be utilized. The fascia of said protractor is stamped with all numerals (u) reading horizontally for rapid calculation and location of given angles. Said protractor is serrated at each of the 5° intervals thereby enabling user to quickly ascertain and mark a given object at a determined angle. Special aperatures are provided at d and e as well as at h and i the center points for the right and left 180 degree protractor sets. The 90° arm of the protractor's right half (r) includes the tool name stamp or Trademark (k) (not printed on drawing). (3) The vise is conceived so as to provide a holding tolerance for materials as small as ¼" thickness to approximately 2¼" in general practice. The vise structure comprises a heavy gauge spring (o) wound about the center pin (m) and suspended thereby between the side sleeves (l & n) and causing a pivot of the clamp (s) about the second pin (t) which transverses and connects the side sleeves (l & n). The main bearing sleeves (1) of said invention's fascia mesh on the outside of the clamp (s) bearing sleeves (n) so as to provide a lateral or antitwist support once the vise in engaged. The extreme binding surface of the clamp member (s) is etched in criss cross fashion to provide a non-slip surface though maintaining a smooth profile. The clamp (s) is curved to an arc that engages all materials in said holding tolerance after materials engage the squaring and pivot member (j) located of course in the exact horizontal of the aformentioned 90° dividing line. The squaring and pivot member or flange (j) extends as shown in phantom in FIG. 1 between the left and right centers apertures (h) and (i) for the left and right protractor sections so that the ends of the squaring and pivoting member (j) provide pivot and centering points for the protractors when the member (j) is placed against a workpiece. Both the ruled straight-edge (p) and clamp (s) have dip molded vinyl handles and are slightly contoured for ease in operation.

I claim:

1. A measuring and angle marking device comprising an elongated flat member having spaced parallel straight edges; a spacing and pivot flange mounted to the underside face of said flat member intermediate the elongated length thereof for dividing said member into a handle portion and a relatively longer major guiding and marking portion, said guiding and marking portion having a calibrated scale along one of said straight edges with its zero index at said flange and progressing out therefrom; said flange extending transversely between and terminating at said straight edges, with the ends of said flange providing a first pivot point aligned with the calibrated straight edge and at the zero index of said scale and a second pivot point aligned with the other second straight edge; first and second apertures in said flat member at said first and second pivot points; first and second ninty degree protractor segments integrally formed and coplanar with said flat member; said first protractor segment positioned on said guiding and marking portion having its center at said first pivot point and its zero line coinciding with said scaled edge and its ninty degree line aligned with the transverse line defined by said flange; said second ninty degree protractor segment positioned on said handle portion with its center on said second pivot point and its zero degree line aligned with said second straight edge and the ninty degree line coinciding with said ninty degree line of said first segment; said first protractor segment is graduated from 0 to 90 degrees in a counterclockwise direction from the zero degree line and said second segment is graduated from 0 to 90 degrees in a clockwise direction from the zero degree line so that said segments are positioned on the flat member wholly to the side opposite said calibrated straightedge; and spring biased clamping rise means on the underface of said handle portion for securely clamping the device on work material to be marked or cut, with said marking and guiding portion adapted to overlie the material and said flange abutting an edge of said work material.

* * * * *